United States Patent [19]

Campbell et al.

[11] Patent Number: 5,048,303

[45] Date of Patent: Sep. 17, 1991

[54] OPEN FRONT REFRIGERATED DISPLAY CASE WITH IMPROVED AMBIENT AIR DEFROST MEANS

[75] Inventors: Bradley J. Campbell, Newtown; Ronald R. Rosanio, Levittown, both of Pa.

[73] Assignee: Hill Refrigeration Division of the Jepson Corporation, Trenton, N.J.

[21] Appl. No.: 553,046

[22] Filed: Jul. 16, 1990

[51] Int. Cl.[5] ..... A47F 3/04

[52] U.S. Cl. ..... 62/256; 62/282

[58] Field of Search ..... 62/82, 256, 282

[56] References Cited

U.S. PATENT DOCUMENTS

| | | | |
|---|---|---|---|
| 2,594,066 | 4/1952 | Pabst | 62/255 |
| 3,226,945 | 1/1966 | Spencer | 62/256 |
| 4,182,130 | 1/1980 | Ljung | 62/256 X |
| 4,242,882 | 1/1981 | Abraham | 62/256 |
| 4,449,374 | 5/1984 | Ibrahim | 62/256 X |

*Primary Examiner*—William E. Tapolcai

*Attorney, Agent, or Firm*—Sperry, Zoda & Kane

[57] ABSTRACT

An open front refrigerated display case having an improved ambient air defrost system which includes a housing with a display compartment area for displaying articles therein and an open front area to facilitate placement and removal of the articles, a main refrigeration duct extends throughout the housing having a primary inlet above the open front area and a primary outlet defined below the front area, a primary refrigeration coil is positioned within the primary refrigeration duct for cooling of air passing therethrough and a primary fan device is positioned within the primary refrigeration duct to facilitate drawing of air through the air inlet and expelling of refrigerated air through the air outlet in such a manner as to form an air curtain across the open front area. An ambient air defrost system is included having an ambient air circulation device such as a fan and an ambient air drive means for powering thereof. A one-way ambient air flow restriction device is included preferably having a header member and an air damper means pivotally movable with respect thereto between a refrigeration mode position and a defrosting mode position. The one-way ambient air restriction device allowing full air flow when in the refrigeration mode while allowing restricted air flow while in the defrosting mode,. Preferably the air damper device includes a plurality of air flow apertures defined therein to facilitate restricted flow therethrough in the reverse direction during ambient air defrost.

19 Claims, 2 Drawing Sheets

OPEN FRONT REFRIGERATED DISPLAY CASE WITH IMPROVED AMBIENT AIR DEFROST MEANS

BACKGROUND OF THE INVENTION

1. Field Of The Invention

The present invention deals with the field of refrigerated display cases and more particularly with the field of open front refrigerated display cases wherein one or more air curtains are defined extending vertically across the open front area defined therein. Such open front refrigerated display cases retain refrigerated air therein and yet facilitate easy removal of product displayed therein by a shopper.

The open front refrigerated display case of the present invention deals more particularly with those cases having an ambient air defrost means which have been found to be highly energy efficient and aid in the defrosting of the refrigerating coil thereof without requiring external heaters or use of hot refrigerant gases. Such ambient air defrost systems have proved unsatisfactory because of the recirculation of cool air during ambient defrost rather than allowing dry room temperature ambient air to constantly be passed over the refrigeration coil for cooling. The present invention provides a means for overcoming the recirculation of cooled air and provides a continuous supply of ambient air to the ambient air defrost device during ambient air defrost operation.

2. Description Of The Prior Art

Open front refrigerated display cases and particularly those including ambient air defrost systems have included many different patented configurations such as U.S. Pat. No. 2,463,614 patented Mar. 8, 1949 to H. Hardin on an Open-Top Display Refrigerator; U.S. Pat. No. 2,495,554 patented Jan. 24, 1950 to G. Spangler on an Open top Refrigerated Display Case; U.S. Pat. No. 2,594,066 patented Apr. 22, 1952 to R. Pabst on a Two-Decker Dairy Self-Service Refrigerator; U.S. Pat. No. 2,630,684 patented Mar. 10, 1953 to M. Strang on a Refrigerated Multiple Shelf Display Case; U.S. Pat. No. 2,952,992 patented Sept. 20, 1960 to D. Voorhies on a Refrigerated Shelf; U.S. Pat. No. 2,993,349 patented July 25, 1961 to W. Detwiler on a Refrigerated Display Case; U.S. Pat. No. 3,094,851 patented June 25, 1963 to S. Beckwith on a Refrigeration Cabinet And Defrost; U.S. Pat. No. 3,103,796 patented Sept. 17, 1963 to E. Dickson et al on a Refrigeration System; U.S. Pat. No. 3,186,185 patented June 1, 1965 to G. Bently et al on a Refrigerated Display Unit; U.S. Pat. No. 3,229,475 patented Jan. 18, 1966 to J. Balk et al on a Refrigerated Display Case; U.S. Pat. No. 3,287,929 patented Nov. 29, 1966 to S. Beckwith on a Refrigerated Cabinet With Improved Nozzle Construction; U.S. Pat. No. 3,304,736 patented Feb. 21, 1967 to J. Brennan et al on a Refrigerated Display Case; U.S. Pat. No. 3,304,740 patented Feb. 21, 1967 to E. Dickson et al on an Open Front Display Case; U.S. Pat. No. 3,319,557 patented May 16, 1967 to A. Perez on a Self-Adjusting Air Deflector; U.S. Pat. No. 3,324,676 patented June 13, 1967 to L. Gerweck on a Refrigerated Display Case; U.S. Pat. No. 3,365,908 patented Jan. 30, 1968 to M. MacMaster on a Display Case; U.S. Pat. No. 3,369,375 patented Feb. 20, 1968 to L. Gerweck et al on a Refrigerated Display Case; U.S. Pat. No. 3,403,525 patented Oct. 1, 1968 to S. Beckwith et al on a Defrost System For Air Curtain Type Refrigerated Display Case; U.S. Pat. No. 3,465,536 patented Sept. 9, 1969 to R. Vogel et al on a Removable Cover For Access Opening Of Refrigerated Cabinet; U.S. Pat. No. 3,499,295 patented Mar. 10, 1970 to J. Brennan on a Refrigeration System; U.S. Pat. No. 3,501,925 patented Mar. 24, 1970 to J. Brennan et al on Refrigerated Equipment; U.S. Pat. No. 3,517,526 patented June 30, 1970 to M. MacMaster et al on Refrigerated Equipment; U.S. Pat. No. 3,528,258 patented Sept. 15, 1970 to J. Brennan on a Refrigerated Display Case; U.S. Pat. No. 3,531,945 patented Oct. 6, 1970 to J. Brennan on Constant Temperature Refrigerated Equipment; U.S. Pat. No. 3,648,482 patented Mar. 14, 1972 to S. Beckwith et al on a Method And Apparatus For Producing Refrigerating Constructions; U.S. Pat. No. 3,675,440 patented July 11, 1972 to F. Ibrahim on a Refrigerated Display Case; U.S. Pat. No. 3,751,653 patented Aug. 7, 1973 to J. Henry on a Refrigerated Display Case; U.S. Pat. No. 3,756,038 patented Sept. 4, 1973 to M. MacMaster et al on Refrigerated Display Equipment; U.S. Pat. No. 3,827,254 patented Aug. 6, 1974 to M. MacMaster on a Refrigerated Display Case; U.S. Pat. No. 3,850,003 patented Nov. 26, 1974 to S. Beckwith et al on an Air Defrost Air Curtain Display Case; U.S. Pat. No. 3,937,033 patented Feb. 10, 1976 to S. Beckwith et al on an Air Defrost Display Case; U.S. Pat. No. 4,077,228 patented Mar. 7, 1978 to N. Schumacher et al on a Refrigerated Display Case; U.S. Pat. No. 4,144,720 patented Mar. 20, 1979 to E. Subera et al on an Air Defrost System Using Secondary Air Band Components; U.S. Pat. No. 4,302,946 patented Dec. 1, 1981 to F. Ibrahim on a Refrigeration System Using Air Defrost; U.S. Pat. No. 4,319,463 patented Mar. 16, 1982 to H. Ljung on a Refrigerated Display Chest; U.S. Pat. No. 4,320,631 patented Mar. 23, 1982 to J. Vana on an Air Defrost For Low-Bed Refrigerated Display Cases, Utilizing Sill-Mounted Auxiliary Fan; U.S. Pat. No. 4,375,155 patented Mar. 1, 1983 to R. Rosanio et al on a Reach-In Refrigerated Display Case With Ambient Air Defrost; U.S. Pat. No. 4,514,988 patented May 7, 1985 to F. Ibrahim on a Refrigerated Display Case Having Ambient Air Defrost; U.S. Pat. No. 4,592,209 patented June 3, 1986 to G. Casanova et al on a Display Counter For Food Products, Refrigerated By Forced Ventilation; U.S. Pat. No. 4,750,335 patented June 14, 1988 to G. Wallace et al on an Anti-Condensation Means For Glass Front Display Cases; and U.S. Pat. No. 4,760,708 patented Aug. 2, 1988 to M. Karashima on a Refrigerated Showcase.

SUMMARY OF THE INVENTION

The present invention includes an open front refrigerated display case having an improved ambient air defrost system. The open front refrigerated display case included a housing with a display compartment area therein adapted for receiving and retaining articles. An open front area is defined in the housing means to facilitate placement and removal of articles positioned in the display compartment.

A primary refrigeration system is included having a primary refrigeration duct extending through the housing with the duct defining a primary inlet below the open front area and a primary outlet above the open front area. The primary refrigeration duct is adapted to expel refrigerated air from the primary outlet to pass over the open front area and into the primary inlet to form a primary refrigeration curtain extending thereover. A primary refrigeration coil is positioned within the primary refrigeration duct to receive air flowing therethrough to facilitate refrigeration thereof. The primary refrigeration coil is rendered in operative during defrosting operation.

A primary fan is positioned within the primary refrigeration duct to facilitate air flow therethrough. The primary fan is operative to urge air flow through the primary refrigeration duct from the primary inlet to the primary outlet during refrigeration by the primary refrigeration coil. The primary fan is operative to urge air flow through the primary refrigeration duct from the primary outlet to the primary inlet during defrosting of the primary refrigeration coil. A primary drive is operatively connected with respect to the primary fan for powering thereof. An ambient air defrost system is included operable to periodically defrost the primary refrigeration coil as required. This ambient air defrost system includes an ambient air circulation device which may take the form of the primary fan. The air circulation device draws ambient air through the primary refrigeration duct and thus through the primary refrigeration coil to facilitate ambient air defrost thereof. The ambient air fan circulation device may make use also of the primary drive for powering of the fan in a reverse direction.

An ambient air drive is included operatively driving the ambient air circulation means.

A one-way ambient air flow restriction device is included for controlling air flow through the primary refrigeration duct during ambient air defrost in a such a manner as to allow full air flow through the refrigeration duct during normal refrigeration mode operation and yet allowing only restricted flow during reverse flow ambient air defrost.

The one-way ambient air flow restriction device may preferably include a header member fixedly secured with respect to the primary refrigeration duct and an air damper mounted pivotally movable with respect to the header member. In this manner the air damper is movable between a refrigeration mode position and a defrosting mode position responsive to air pressure being exerted thereon. The air damper is operable while in the refrigeration mode position to allow full air flow through the primary refrigeration duct from the primary inlet to the primary outlet. The air damper is operable while in the defrosting mode to extend across the refrigeration duct to restrict air flow therethrough. The air damper preferably includes a plurality of air flow apertures defined therein to facilitate restricted air flow therepast responsive to the air damper being in the defrosting mode position. The air damper is responsive to being in this defrosting mode position to restrict the reversed air flow utilized during ambient air defrost. Preferably the air damper restricts primary flow to approximately 300 cubic feet per minute facilitating defrosting of the refrigeration coil means while minimizing recirculation of cool air during ambient air defrost.

The open front display case of the present invention may further include defined therein a secondary cooling system including a secondary duct extending through the housing such as to define a secondary inlet below the open front area adjacent the primary inlet. This secondary duct may further include a secondary outlet above the open front area adjacent the primary outlet. The secondary refrigeration duct is adapted to expel air from the secondary outlet to pass over the open front area and into the secondary inlet to thereby form a secondary refrigeration air curtain extending thereover. A secondary fan device is preferably positioned within the secondary duct to facilitate air flow from said secondary inlet to said secondary outlet.

Furthermore an ambient air flow control means may be included within the present invention including an ambient duct extending through the housing in such a manner as to define an ambient inlet positioned within the housing above the open front area and further defining an ambient outlet within the housing above the open front area. The ambient outlet is adapted to expel air therefrom over the open front area to form an ambient air curtain extending thereover. An ambient fan may be positioned within the ambient duct to facilitate ambient air flow therethrough from the ambient inlet to the ambient outlet.

The present invention may further include a bin area supplemental refrigeration system defining a display bin refrigeration outlet positioned within the primary refrigeration duct between the primary refrigeration coil and the primary outlet adjacent the display bin area to facilitate refrigeration thereof. The display bin refrigeration outlet is adapted to expel refrigerated air therefrom across the display bin area into the primary inlet to form a bin refrigeration air curtain extending approximately horizontally thereover.

Restriction of reverse flow with the present invention can be achieved by use of the air damper means which receives air pressure thereon during reverse flow conditions to restrict reverse air flow. Alternatively reverse air flow can be restricted by operation of the primary refrigeration fan means in the reverse direction at a reduced speed. In this manner recirculation of cool air during ambient air defrost will be minimized such that room temperature or ambient air will be continuously supplied to the primary refrigeration outlet during reverse flow ambient air defrost.

It is an object of the present invention to provide an open front refrigeration display case having an improved ambient air defrost means wherein energy requirements are minimized.

It is an object of the present invention to provide an open front refrigeration display case having an improved ambient air defrost means wherein initial capital costs are minimized.

It is an object of the present invention to provide an open front refrigeration display case having an improved ambient air defrost means wherein maintenance requirements are minimized.

It is an object of the present invention to provide an open front refrigeration display case having an improved ambient air defrost means wherein a continuous supply of ambient air is made available for ambient defrost thereof.

It is an object of the present invention to provide an open front refrigeration display case having an improved ambient air defrost means wherein refrigerated air is removed from the path ambient air circulation during defrost.

It is an object of the present invention to provide an open front refrigeration display case having an improved ambient air defrost means wherein no resistance heating element is required for heating during defrosting.

It is an object of the present invention to provide an open front refrigeration display case having an improved ambient air defrost means wherein defrosting can be time initiated.

It is an object of the present invention to provide an open front refrigeration display case having an improved ambient air defrost means wherein defrost can be demand initiated.

It is an object of the present invention to provide an open front refrigeration display case having an improved ambient air defrost means wherein defrost can be temperature terminated.

It is an object of the present invention to provide an open front refrigeration display case having an improved ambient air defrost means wherein reverse air flow through the primary refrigeration duct is powered by the primary blower means reverse circulating ambient air.

It is an object of the present invention to provide an open front refrigeration display case having an improved ambient air defrost means wherein reverse flow during ambient air is restricted to approximately 300 feet per minute.

It is an object of the present invention to provide an open front refrigeration display case having an improved ambient air defrost means wherein a restricted reverse flow is achieved by the positioning of a primary air damper providing a one-way valve for air flow.

It is an object of the present invention to provide an open front refrigeration display case having an improved ambient air defrost means wherein a one-way valve for air flow allows free circulation of air through the primary refrigeration system during refrigeration mode operation and restricts reverse flow of ambient air during defrost operation.

It is an object of the present invention to provide an open front refrigeration display casing having an improved ambient air defrost means wherein movement of an air damper to restrict reverse flow is achieved without external powering thereof but only as a result of air pressure exerted thereagainst.

BRIEF DESCRIPTION OF THE DRAWINGS

While the invention is particularly pointed out and distinctly claimed in the concluding portions herein, a preferred embodiment is set forth in the following detailed description which may be best understood when read in connection with the accompanying drawings, in which:

DETAILED DESCRIPTION OF THE PREFERRED EMBODIMENT

Figure 1:
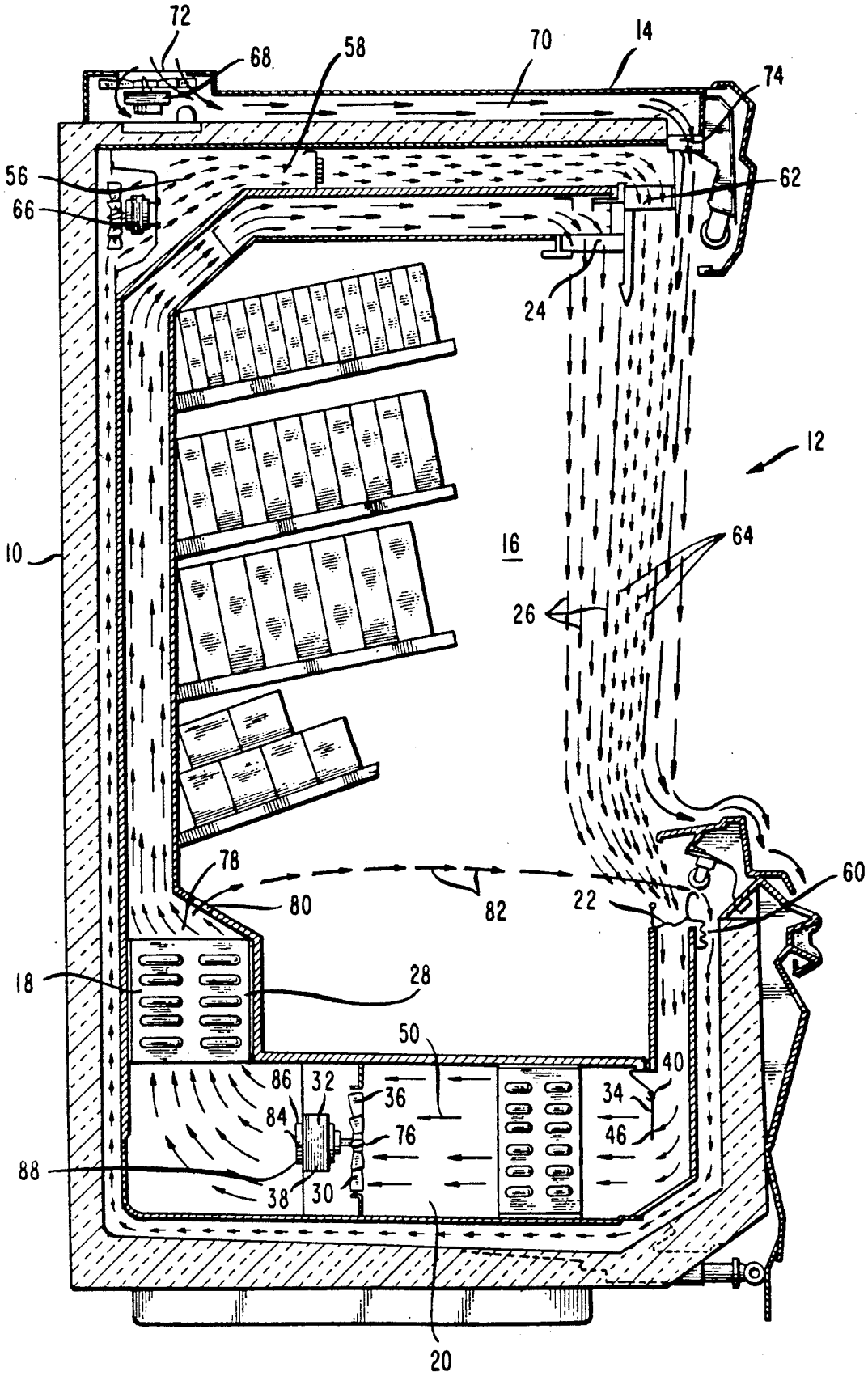
FIG. 1 is a side cross-sectional view of an embodiment of the open front refrigerated display case with improved ambient air defrost means of the present invention showing the primary air damper in the refrigeration mode position.

The present invention provides a refrigerated display case 10 having a housing 14 defining an open front area 12 extending thereover. The housing 14 defines a display compartment 16 therein for holding a plurality of articles 17.

A primary refrigeration means 18 is positioned within the refrigerated display case 10 including a primary refrigeration duct 20 extending therethrough. Primary refrigeration duct 20 includes a primary inlet 22 and a primary outlet 24 to facilitate the formation of a primary refrigeration curtain 26 extending across the open front area 12.

The primary refrigeration coil means 28 is positioned within the primary refrigeration duct to facilitate cooling of air drawn in through the primary inlet 22 to allow refrigerated air to pass outwardly through primary outlet 24 for recirculation through primary inlet 22 thereby forming the primary refrigeration curtain 26. Movement of air through the primary refrigeration duct 20 is achieved by the primary fan means 30. Primary fan 30 is driven by a primary drive means 32.

The present invention provides a novel ambient air defrost means 34 including an ambient air circulation means 36 preferably operating also within the same system as the primary fan 30. Ambient air circulation means 36 is preferably driven by an ambient air drive means 38 which is preferably identical to the primary drive means 32. In this manner ambient air defrost can be achieved by operation of the primary drive means 32 in an opposite direction such that the primary fan 30 is adapted to draw ambient air for passing in a reverse direction through the primary refrigeration duct 20. This reverse circulation through primary refrigeration coil 28 will achieve ambient air defrost thereof.

Control of the reverse ambient air defrost flow through primary refrigeration duct 20 is achieved by a one-way air flow restriction means. Preferably the ambient air flow restriction means 40 includes a header member 42 fixedly secured with respect to the primary refrigeration duct 20. An air damper means 44 is preferably pivotally attached with respect to the header member 42 such as to be pivotally movable with respect thereto between a refrigeration mode position 46 and a defrosting mode position 48.

During refrigeration air flow shown by arrows 50 in FIG. 1 the air damper means 44 will be positioned in a refrigeration mode position 46 allowing full air flow through the primary refrigeration duct 20 as shown in FIG. 1 in the clockwise direction. Air will pass through the primary refrigeration coil 28 to facilitate refrigeration thereof and will pass outwardly through primary outlet 24 and back into the refrigeration duct through primary inlet 22 thereby forming the primary refrigeration curtain 26 thereover.

In the defrosting mode position shown by arrows 48 defrosting reverse air flow shown by arrows 52 will pass through primary refrigeration duct 20. With the ambient air defrosting reverse flow 52, ambient air will preferably be drawn in through the primary outlet 24. This ambient air will pass downwardly through the primary refrigeration duct 20 in a counterclockwise direction as shown in FIG. 1, defined as reverse ambient air defrost flow. This ambient air will be caused to move in this reverse direction preferably by reverse operation of the primary drive 32 causing the primary fan means 30 to operate in a direction opposite from the direction it operates during main refrigeration.

Figure 2:
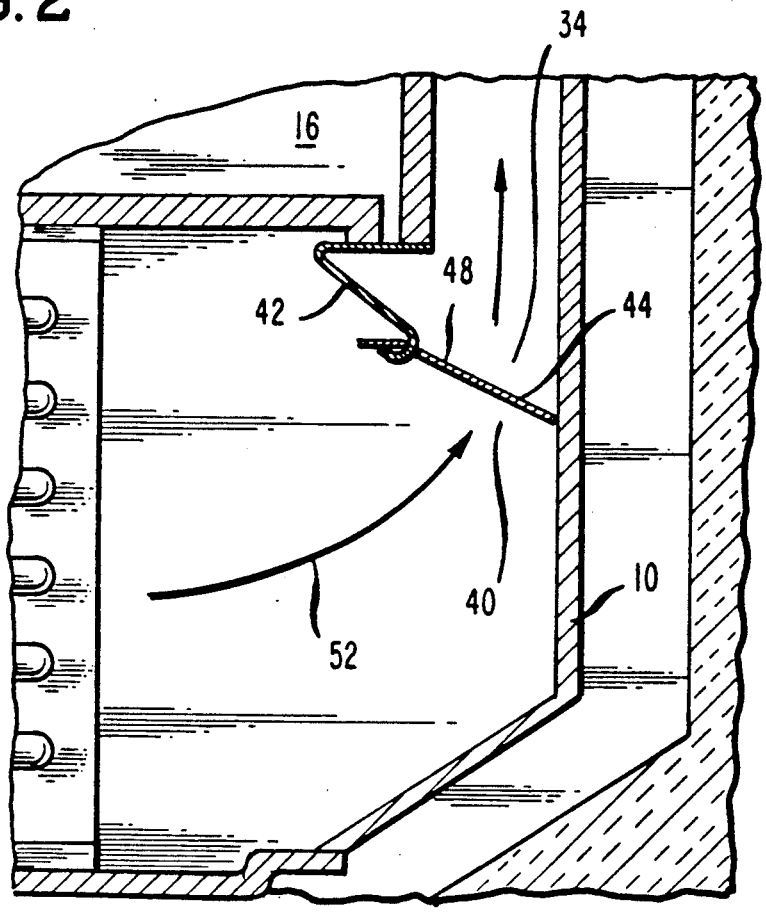
FIG. 2 is a partial illustration of a section of FIG. 1 showing the primary air damper in the defrost mode position.
Figure 3:
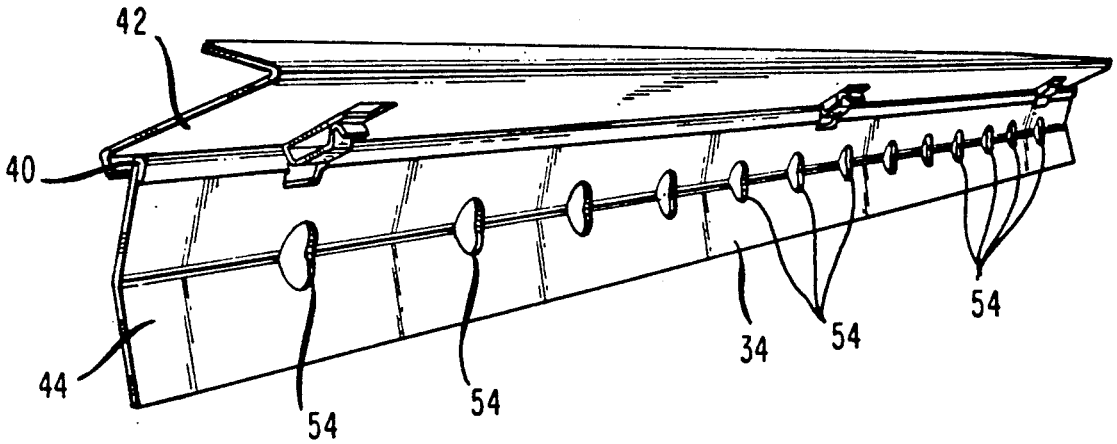
FIG. 3 is an illustration of an embodiment of a primary air damper of the present invention.

It has been determined that the reverse defrosting air flow 52 should be at a speed substantially less than the speed of operation in the opposite direction during refrigeration. In this manner the heat of the ambient air passing in a reverse direction through the duct can be more efficiently discharged into the primary refrigeration coil 28 to facilitate defrosting thereof. For this reason the air damper means 44 is movable to the defrosting mode position 48 shown in FIG. 2. In the defrosting mode position 48 the air damper means 44 will greatly restrict reverse air flow to approximately 300 feet per minute. The air pressure of the reverse ambient flow through the refrigeration duct 20 will urge the air damper means 44 to move to the defrosting mode position 48 shown in FIG. 2. Preferably the air damper means 44 will define a plurality of air flow apertures 54 therein to allow an amount of air flow, although in a restricted fashion, therethrough during defrost.

As such the air damper 44 will act as a baffle responsive to air pressure such as to provide a one-way air flow restriction means. There will be no restriction provided by the air damper means 44 when air is passing in the clockwise direction shown by refrigeration air flow 50 in FIG. 1. There will however be restriction resulting from the reverse air flow achieved during defrosting air flow 52 during defrosting of the primary refrigeration coil 28. Movement of the air damper 44 between the defrosting position 48 and the refrigeration position 46 will be achieved solely by air pressure exerted thereagainst. In this manner an easily maintained and a very efficiently operating reverse air flow restriction means can be achieved at minimal expense and having virtually no maintenance requirements whatsoever.

The refrigerated display case 10 of the present invention may include a secondary cooling means 56 including a secondary refrigeration duct 58 extending through the housing 14. The secondary refrigeration duct 58 preferably defines a secondary inlet 60 and a secondary outlet 62. A secondary refrigeration air curtain 64 is formed by air passing outwardly through secondary outlet 62 and downwardly across the open front area 12 and again re-entering the secondary inlet 60. A secondary fan means 66 is positioned within the secondary refrigeration duct to facilitate air flow therethrough. An ambient air flow control means 68 may be positioned within the refrigerated display case 10 and be adapted to draw ambient air through the ambient air inlet 72 to expel air through the ambient outlet 74 to form an ambient air curtain across the open front area 12 to further facilitate isolation of the refrigerated environment within the display case from the external environment. An ambient fan means 76 may be positioned within the ambient duct 70 to facilitate urging of ambient air therethrough.

Furthermore a bin area supplemental refrigeration means 78 may be included defining a display bin refrigeration outlet means 80 to form a bin refrigeration air curtain 82 extending across the lower bin area within the display compartment 16.

An electrical means 84 may be included such as a rheostat means 86 or an in-line resistor means 88 for controlling operation of the drive means of the primary fan 30. This control may include reduction in the speed of operation of the primary fan 30 during defrosting operations to further restrict reverse ambient air defrost during ambient air defrosting operation.

While particular embodiments of this invention have been shown in the drawings and described above, it will be apparent, that many changes may be made in the form, arrangement and positioning of the various elements of the combination. In consideration thereof it should be understood that preferred embodiments of this invention disclosed herein are intended to be illustrative only and not intended to limit the scope of the invention.

I claim:

1. An open front refrigerated display case with improved ambient air defrost means comprising:

(a) a housing means comprising:
  (1) a display compartment area adapted for receiving and retaining articles therein;
  (2) an open front area to facilitate placement and removal of articles positioned within said display compartment area;

(b) a primary refrigeration means comprising:
  (1) a primary refrigeration duct means extending through said housing means, said primary refrigeration duct means defining a primary inlet below said open front area and a primary outlet above said open front area, said primary refrigeration duct means being adapted to expel refrigerated air from said primary outlet to pass over said open front area and into said primary inlet to form a primary refrigeration curtain thereover;
  (2) a primary refrigeration coil means positioned within said primary refrigeration duct means to receive air flowing therethrough for refrigeration thereof;
  (3) a primary fan means positioned within said primary refrigeration duct means to facilitate air flow therethrough,
  (4) a primary drive means operatively connected with respect to said primary fan means to power operation thereof;

(c) an ambient air defrost means operable to periodically defrost said primary refrigeration coil means as required, said ambient air defrost means including:
  (1) an ambient air circulation means for drawing ambient air through said primary refrigeration duct means through said primary refrigeration coil means to facilitate ambient air defrost thereof;
  (2) an ambient air drive means for operatively driving of said ambient air circulation means to facilitate operation thereof;
  (3) a one-way ambient air flow restriction means for controlling air flow through said primary refrigeration duct means during ambient air defrost and allowing full air flow through said refrigeration duct means during normal refrigeration mode operation, said one-way ambient air flow restriction means further comprising an air damper means pivotally movable with respect to said primary refrigeration duct means and movable between a refrigeration mode position and a defrosting mode position, said air damper means operable while in the refrigeration mode position to allow full air flow through said primary refrigeration duct means from said primary inlet to said primary outlet, said air damper means operable while in the defrosting mode to restrict air flow through said primary refrigeration duct means;

(d) a secondary cooling means comprising:
  (1) a secondary duct means extending through said housing means, said secondary duct means defining a secondary inlet below said open front area adjacent said primary inlet, said secondary duct means further including a secondary outlet above said open front area adjacent said primary outlet, said secondary refrigeration duct means being adapted to expel air from said secondary outlet to pass over said open front area and into said secondary inlet to form a secondary refrigeration air curtain thereover;

(2) a secondary fan means positioned within said secondary duct means to facilitate air flow therethrough;

(e) an ambient air flow control means comprising:

(1) an ambient duct means extending through said housing means, said ambient duct means defining an ambient inlet in said housing and further defining an ambient outlet within said housing above said open front area, said ambient outlet being adapted to expel air therefrom over said open front area to form an ambient air curtain extending thereover; and (2) an ambient fan means positioned within said ambient duct means to facilitate ambient air flow therethrough from said ambient inlet to said ambient outlet.

2. An open front refrigerated display case with improved ambient air defrost means as defined in claim 1 wherein said primary refrigeration coil means is inoperable during defrosting and wherein said primary fan means is operable in a reverse direction during defrosting to facilitate reverse air flow through said primary refrigeration duct means during defrosting of said primary refrigeration coil means.

3. An open front refrigerated display case with improved ambient air defrost means as defined in claim 2 wherein said air damper means is operable while in the defrosting mode position to restrict air flow through said primary refrigeration duct means in a reverse direction from said primary outlet means therethrough to said primary inlet means.

4. An open front refrigerated display case with improved ambient air defrost means as defined in claim 1 wherein said air damper means includes aperture means defined therein to allow restricted defrost air flow therethrough when located at the defrosting mode position.

5. An open front refrigerated display case with improved ambient air defrost means as defined in claim 4 wherein said aperture means includes a plurality of individual apertures located along said air damper means to facilitate restricted air flow therethrough.

6. An open front refrigerated display case with improved ambient air defrost means as defined in claim 1 wherein said air damper means is movable to a position extending across said primary refrigeration duct means while in the defrost mode position.

7. An open front refrigerated display case with improved ambient air defrost means as defined in claim 1 wherein said air damper means includes a header member fixedly attached with respect to said primary refrigeration duct means and wherein said air damper means is pivotally secured with respect thereto.

8. An open front refrigerated display case with improved ambient air defrost means as defined in claim 2 wherein said one-way ambient air flow restriction means comprises electrical restriction means operatively connected with respect to said primary drive means to limit reverse operation thereof and thus restrict reverse airflow through said primary refrigeration duct means during defrost thereof.

9. An open front refrigerated display case with improved ambient air defrost means as defined in claim 8 wherein said electrical restriction means comprises a rheostat means electrically connected with respect to said primary drive means.

10. An open front refrigerated display case with improved ambient air defrost means as defined in claim 8 wherein said electrical restriction means comprises an inline resistor means electrically connected with respect to said primary drive means.

11. An open front refrigerated display case with improved ambient air defrost means as defined in claim 1 wherein said ambient air inlet means is positioned within said housing means above said open front area.

12. An open front refrigerated display case with improved ambient air defrost means as defined in claim 1 wherein said ambient air circulation means comprises said primary fan means.

13. An open front refrigerated display case with improved ambient air defrost means as defined in claim 1 wherein said ambient air drive means comprises said primary drive means.

14. An open front refrigerated display case with improved ambient air defrost means as defined in claim 1 wherein said air damper means is operable responsive to being in the defrosting mode position to allow approximately 300 feet per minute to pass through said primary refrigeration duct means for defrosting of said primary refrigeration coil means.

15. An open front refrigerated display case with improved ambient air defrost means as defined in claim 1 wherein said air damper means is urged to the defrosting mode position by air pressure exerted thereon by ambient defrosting air flow passing in a reverse direction through said primary refrigeration duct means.

16. An open front refrigerated display case with improved ambient air defrost means as defined in claim 15 wherein said air damper means responsive to being in the defrosting mode position is adapted to extend across said primary refrigeration duct means for restricting air flow therethrough.

17. An open front refrigerated display case with improved ambient air defrost means as defined in claim 1 further comprising a bin area supplemental refrigeration means defining a display bin refrigeration outlet means positioned within said primary refrigeration duct means between said primary refrigeration coil and said primary outlet adjacent said display bin area to facilitate refrigeration thereof, said display bin refrigeration outlet means adapted to expel refrigeration air therefrom across said display bin area into said primary inlet to form a bin refrigeration air curtain extending thereover.

18. An open front refrigerated display case with improved ambient air defrost means comprising:

(a) a housing means comprising:

(1) a display compartment area adapted for receiving and retaining articles therein;

(2) an open front area to facilitate placement and removal of articles positioned within said display compartment area;

(b) a primary refrigeration means comprising:

(1) a primary refrigeration duct means extending through said housing means, said primary refrigeration duct means defining a primary inlet below said open front area and a primary outlet above said open front area, said primary refrigeration duct means being adapted to expel refrigerated air from said primary outlet to pass over said open front area and into said primary inlet to form a primary refrigeration curtain thereover;

(2) a primary refrigeration coil means positioned within said primary refrigeration duct means to receive air flowing therethrough for refrigeration thereof, said primary refrigeration coil means being rendered inoperative during defrosting thereof;

(3) a primary fan means positioned within said primary refrigeration duct means to facilitate air flow therethrough, said primary fan means operative to urge air flow through said primary refrigeration duct means from said primary inlet to said primary outlet during refrigeration by said primary refrigeration coil means, said primary fan means operative to urge air flow through said primary refrigeration duct means from said primary outlet means to said primary inlet means during defrosting of said primary refrigeration coil means;

(4) a primary drive means operatively connected with respect to said primary fan means to power operation thereof;

(c) an ambient air defrost means operable to periodically defrost said primary refrigeration coil means as required, said ambient air defrost means including:

(1) an ambient air circulation means for drawing ambient air through said primary refrigeration duct means through said primary refrigeration coil means to facilitate ambient air defrost thereof, said ambient air circulation means comprising said primary fan means;

(2) an ambient air drive means for operatively driving of said ambient air circulation means to facilitate operation thereof, said ambient air drive means comprising said primary drive means;

(3) a one-way ambient air flow restriction means for controlling air flow through said primary refrigeration duct means during ambient air defrost and allowing full air flow through said refrigeration duct means during normal refrigeration mode operation, said one-way ambient air flow restriction means including:

(a) a header member fixedly attached with respect to said primary refrigeration duct means; and (b) an air damper means mounted pivotally movable with respect to said header member to be movable between a refrigeration mode position and a defrosting mode position, said air damper means operable while in the refrigeration mode position to allow full air flow through said primary refrigeration duct means from said primary inlet to said primary outlet, said air damper means operable while in the defrosting mode to extend across said refrigeration duct means to restrict air flow therethrough, said air damper means defining a plurality air flow apertures therein to facilitate restricted air flow therepast responsive to said air damper means being in the defrosting mode position, said air damper means being operable responsive to being in the defrosting mode position to restrict reverse air flow through said primary refrigeration duct means to approximately 300 feet per minute for defrosting of said primary refrigeration coil means, said air damper means being movable to the defrosting mode position by air flow pressure exerted thereon by ambient defrosting air flow passing in a reverse direction through said primary refrigeration duct means;

(d) a secondary cooling means comprising:

(1) a secondary duct means extending through said housing means, said secondary duct means defining a secondary inlet below said open front area adjacent said primary inlet, said secondary duct means further including a secondary outlet above said open front area adjacent said primary outlet, said secondary refrigeration duct means being adapted to expel air from said secondary outlet to pass over said open front area and into said secondary inlet to form a secondary refrigeration air curtain thereover;

(2) a secondary fan means positioned within said secondary duct means to facilitate air flow therethrough;

(e) an ambient air flow control means comprising:

(1) an ambient duct means extending through said housing means, said ambient duct means defining an ambient inlet positioned within said housing above said open front area and further defining an ambient outlet within said housing above said open front area, said ambient outlet being adapted to expel air therefrom over said open front area to form an ambient air curtain extending thereover;

(2) an ambient fan means positioned within said ambient duct means to facilitate ambient air flow therethrough from said ambient inlet to said ambient outlet; and (f) a bin area supplemental refrigeration means defining a display bin refrigeration outlet means positioned within said primary refrigeration duct means between said primary refrigeration coil and said primary outlet adjacent said display bin area to facilitate refrigeration thereof, said display bin refrigeration outlet means adapted to expel refrigeration air therefrom across said display bin area into said primary inlet to form a bin refrigeration air curtain extending thereover.

19. An improved air defrost means for use with an open front refrigerated display case having a housing means defining a display compartment area adapted for receiving and retaining articles therein and an open front area to facilitate placement and removal of articles positioned within said display compartment area, the refrigerated display case including a primary refrigeration means including a primary refrigeration duct means extending through the housing means, the primary refrigeration duct means defining a primary inlet below the open front area and a primary outlet above the open front area, the primary refrigeration duct means being adapted to expel refrigerated air from the primary outlet to pass over the open front area and into the primary inlet to form a primary refrigeration curtain thereover, a primary refrigeration coil means positioned within the primary refrigeration duct means to receive air flowing therethrough for refrigeration thereof, a primary fan means positioned within the primary refrigeration duct means to facilitate air flow therethrough, a primary drive means operatively connected with respect to the primary fans means to power operation thereof, wherein said improved ambient air defrost means being operable to periodically defrost the primary refrigeration coil means as required and comprising:

(a) an ambient air circulation means for drawing ambient air through the primary refrigeration duct means through the primary refrigeration coil means to facilitate ambient air defrost thereof;

(b) an ambient air drive means for operatively driving of said ambient air circulation means to facilitate operation thereof; and (c) a one-way ambient air flow restriction means for controlling air flow through the primary refrigeration duct means during ambient air defrost and allowing full air flow through the refrigeration duct means during normal refrigeration mode operation thereof said one-way ambient air flow restriction means comprising an air damper means pivotally movable with respect to the primary refrigeration duct means and movable between a refrigeration mode position and a defrosting mode position, said air damper means operable while in the refrigeration mode position to allow full air flow through the primary refrigeration duct means from the primary inlet to the primary outlet, said air damper means operable while in the defrosting mode to restrict air flow through the primary refrigeration duct means.

* * * * *